US005421105A

United States Patent [19]

Schulte

[11] Patent Number: 5,421,105

[45] Date of Patent: Jun. 6, 1995

[54] DREDGING SYSTEM

[76] Inventor: Frank Schulte, County Rd. 357 Box 47, Mayo, Fla. 32066

[21] Appl. No.: 172,148

[22] Filed: Dec. 23, 1993

[51] Int. Cl.[6] ..... E02F 5/28

[52] U.S. Cl. ..... 37/309; 37/317; 37/335; 405/303

[58] Field of Search ..... 172/112, 114; 37/195, 37/305, 306, 307, 308, 309, 311, 313, 321, 320, 317, 335; 405/73, 196, 303

[56] References Cited

U.S. PATENT DOCUMENTS

| | | | |
|---|---|---|---|
| 3,248,812 | 5/1966 | Gardner, Jr. . | |
| 3,365,823 | 1/1968 | Vogt | 37/345 X |
| 3,860,122 | 1/1975 | Cernosek | 214/1 P |
| 4,741,208 | 5/1988 | Vandevier | 73/155 |
| 4,807,373 | 2/1989 | Sloan et al. . | |
| 4,839,061 | 6/1989 | Manchak, Jr. et al. | 37/333 X |
| 4,977,528 | 12/1990 | Norris | 364/571.04 |
| 5,201,212 | 4/1993 | Williams | 73/40.5 |
| 5,267,830 | 12/1993 | Wickoren et al. | 415/99 |

*Primary Examiner*—Randolph A. Reese
*Assistant Examiner*—Robert Pezzuto
*Attorney, Agent, or Firm*—Dowell & Dowell

[57] ABSTRACT

A dredging apparatus for dredging waterways containing sediment includes a hood having a passage for water and sediment to enter the hood under the influence of a submersible dredge pump apparatus. The dredge pump apparatus includes an inlet line having an inlet opening positioned in the passage of the hood, and an outlet line which communicates with the inlet line and extends exteriorly to a spoil collection area. A dredge pump draws water and sediment from within the passage into the inlet opening and through the inlet and outlet lines. To prevent clogging of the inlet line by sediment and ensure a continuous dredging operation, replacement water is introduced adjacent to the inlet opening from a water source in response to sensed pressure variations in the inlet line caused by the onset of clogging. A closed dredging circuit is created by using the spoil collection area as the source of replacement water.

22 Claims, 3 Drawing Sheets

DREDGING SYSTEM

BACKGROUND OF THE INVENTION

The invention is directed to dredging, and, more particularly, to a closed circuit dredging system which circulates the water removed from a dredging area back to the dredging apparatus to mix with the dredged solids so as to prevent clogging of the dredging apparatus.

Dredging is commonly used to remove accumulated sediment from waterways in an effort to maintain them open. For example, dredging is conducted in waterways such as rivers which support shipping when the vessel channels become diminished due to the presence of sediment deposits.

Dredging is also important in areas where agriculture is practiced. In agricultural areas, the runoff of chemicals such as plant fertilizers into the waterways promotes the rapid growth of undesirable vegetation. The growth of vegetation can be so severe in some instances, that the effected waterways are restricted in a short period of time. In such environments, dredging must be performed periodically to prevent closure of the waterways from occurring.

Although the known dredging systems are capable of removing sediment and vegetation from waterways, they also tend to detrimentally affect the surrounding environment. The known dredging systems having conventional dredging scoops have the disadvantage of being unable to efficiently remove relatively lightweight sediment from waterways due to the sediment suspending in the water. To overcome this problem, dredge pumps have been used to draw the sediment out of the waterways. The dredge pumps, however, tend to become clogged by the lightweight sediment. Consequently, the known dredging apparatuses have been unable to operate continuously for extended periods of time without having to periodically discontinue the dredging operation to remove the clogging material.

The problem of clogging has caused the known dredging apparatuses to significantly increase the turbidity of the waterways by disturbing a large amount of sediment during dredging. Consequently, vegetation has been prevented from receiving an adequate amount of sunlight. After the life-supporting vegetation dies, the fish and wildlife which rely on the vegetation for oxygen, cover and food, are forced to seek supporting vegetation in other areas. As a result of the plants and animals leaving the dredged area, ecosystems have been left adversely affected.

The increased turbidity created in the waterways by the known dredging apparatuses has also made it difficult for the operator to visually monitor the progress of the dredging operation. Consequently, the known dredging systems have been restricted by their inefficiency.

SUMMARY OF THE INVENTION

The present invention has been made in view of the above-explained inadequacies of the known dredging systems and has as an object to provide a dredging system which is capable of operating continuously without becoming clogged by sediment.

It is another object of the present invention to provide a dredging system which minimally disturbs dredging areas and the surrounding ecosystem.

Additional objects and advantages of the present invention will become apparent from the description which follows, considered in conjunction with the drawing figures, or by practice of the invention.

To achieve the objects of the invention, as embodied and broadly described, the dredging apparatus for dredging waterways containing sediment in accordance with the invention comprises a hood having a passage for water and sediment to enter, and a submersible dredge pump apparatus. The dredge pump apparatus comprises a housing and an inlet line which defines an inlet opening in communication with the passage of the hood. An outlet line communicates with the inlet line and extends exteriorly from the housing. A dredge pump is provided for drawing water and sediment from within the passage of the hood into the inlet opening and through the inlet and the outlet lines.

To prevent clogging of the inlet line during the dredging operation, the dredge pump apparatus comprises supply means for supplying replacement water from a water source to the passage adjacent to the inlet opening in response to pressure variations in the inlet line due to the onset of clogging.

DETAILED DESCRIPTION OF THE PREFERRED EMBODIMENT

Figure 1:
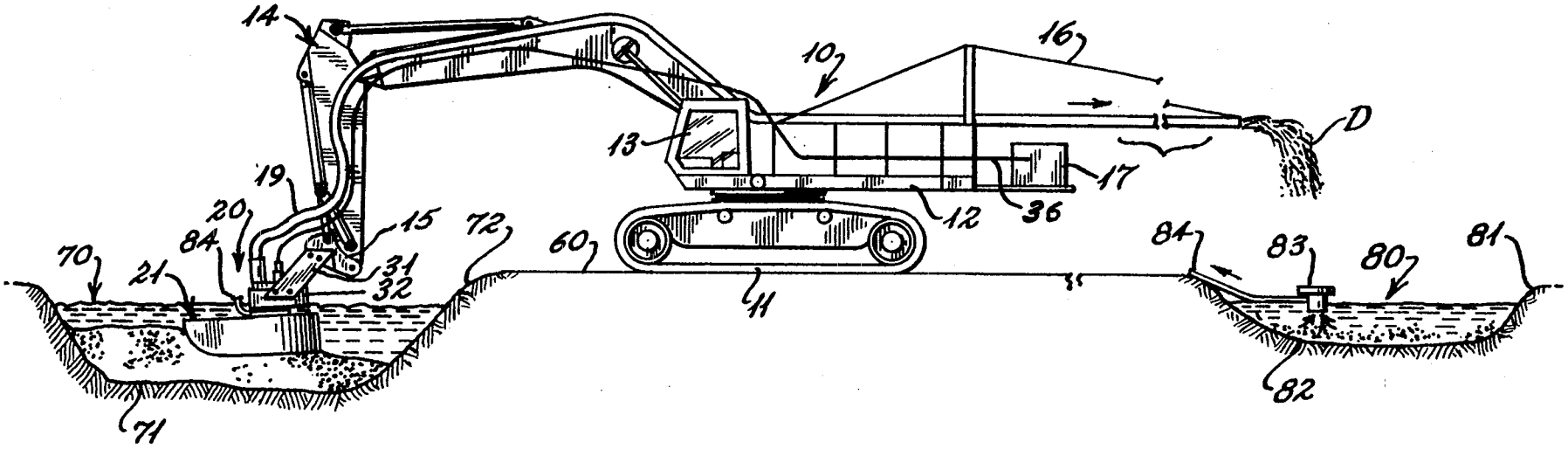
FIG. 1 is an illustrational view of a dredging system including an excavator having an attached dredging apparatus in accordance with a preferred embodiment of the invention.

With reference to the drawing figures, FIG. 1 illustrates a dredging system in accordance with a preferred embodiment of the invention. As shown, an excavator 10 of the type having rotatable tracks 11 for traveling on a wide range of surfaces and terrains is positioned on a ground surface 60 adjacent to a waterway 70. The waterway may be, for example, a drainage channel through an agricultural area. The illustrated waterway contains sediment 71 on its bottom surface and has banks 72 forming its opposite sides. The sediment may be composed of both inorganic and organic matter. The sediment may include rocks, vegetation, tree branches and the like, depending on the nature of the waterway.

The illustrated excavator 10 has a body portion 12 which is rotatable relative to the tracks. A control cab 13 is disposed at the front end of the body portion, and a sectioned hydraulic operated boom 14 extends forwardly from the control cab to a position above the surface of the waterway 70.

In accordance with the invention, other types of excavators such as a backhoe may optionally be utilized as appropriate.

In some instances, and especially in locations where the waterway to be dredged is relatively large, the excavator may be placed on a floatable device such as pontoons to maintain it above the water surface. This allows the entire waterway to be adequately dredged.

A dredging apparatus 20 in accordance with a preferred embodiment of the invention is connected to the front section 15 of the hydraulic boom. An outlet line 19 for transporting dredged solids and liquid out of the waterway extends from the dredging apparatus to behind the rear end of the excavator. The rear portion of the outlet line is maintained substantially parallel to the ground surface by an attached support cable 16.

As illustrated, the dredged material D exits the outlet line and is deposited in a spoil collection area 80 having banks 81 to prevent the dredged material from flowing back into the channel or the surrounding area. The spoil can be periodically removed from the spoil pond by pumping or dredging, and then placed in a suitable transport vehicle such as a tanker. The spoil can be transported to a landfill, or taken to a hazardous waste processing facility or another suitable disposal site depending on its composition.

In accordance with a preferred embodiment of the invention, the liquid portion of the dredged material, which is generally substantially composed of water and which is herein referred to as replacement water, can be recirculated back to the dredging apparatus to create a closed fluid circuit. As depicted, after the spoil 82 has settled to the bottom of the spoil collecting area, the water above the spoil is pumped by a suitable pumping device such as a floating fluid return pump 83 having an outlet replacement water line 84 which is connected at its opposite end to the dredging apparatus.

Figure 3:
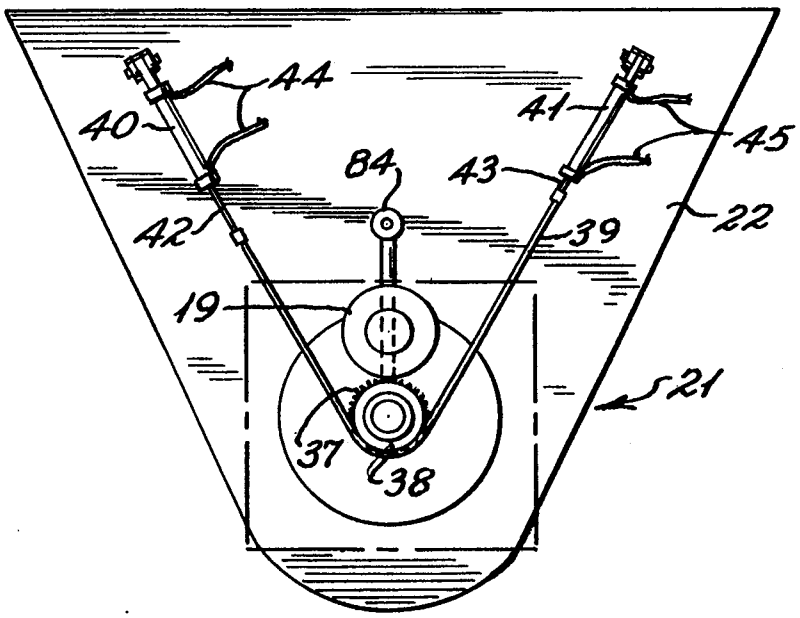
FIG. 3 is a top plan view of the dredging apparatus of FIG. 1.
Figure 2:
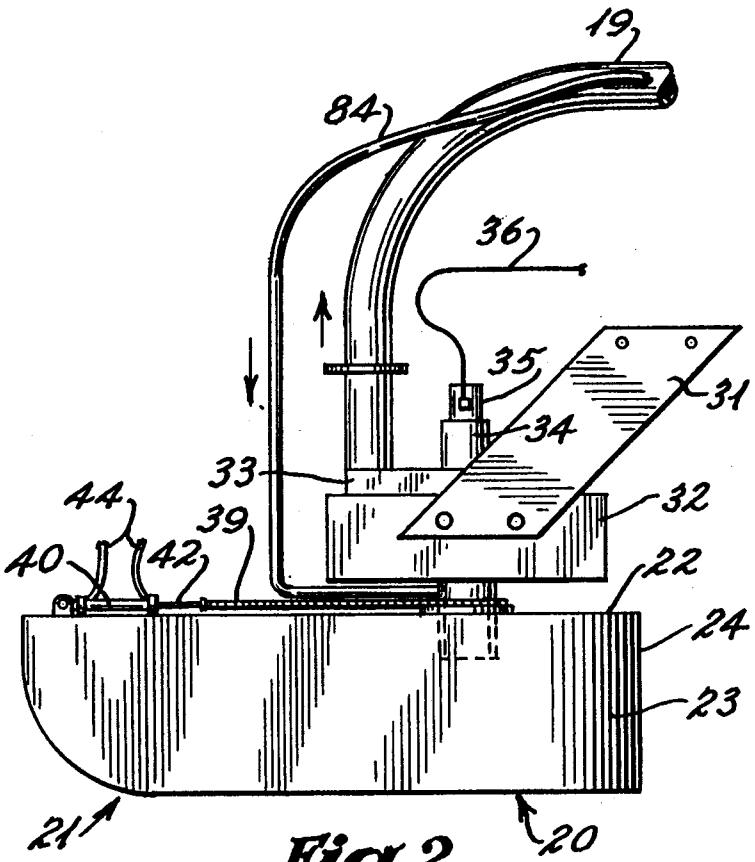
FIG. 2 is a side elevational view of the dredging apparatus of FIG. 1.
Figures 4, 5:
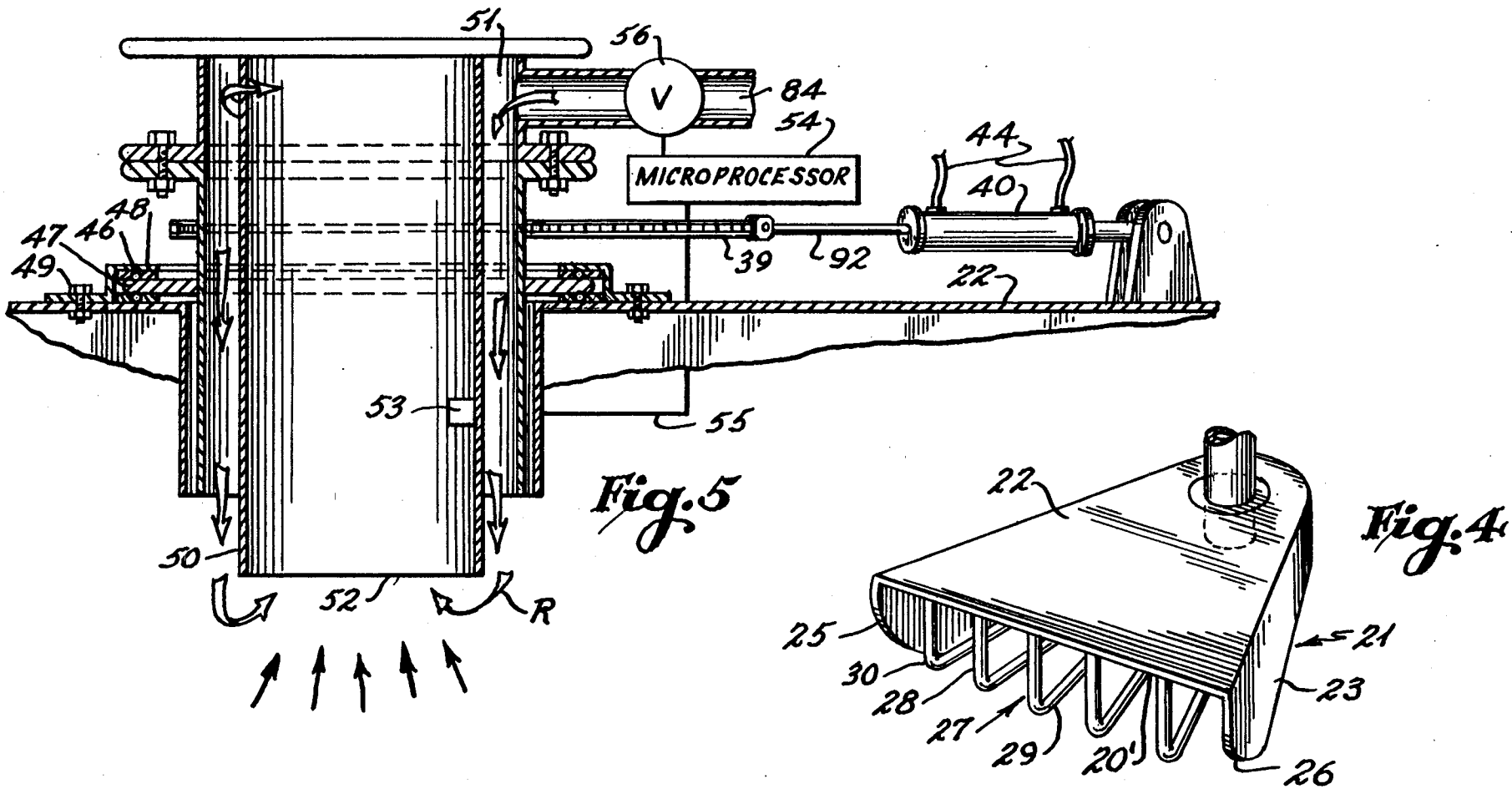
FIG. 4 is a partial front perspective view of the dredging apparatus of FIG. 1.
FIG. 5 is a partially broken away cross-sectional view of the dredging apparatus of FIG. 1.

FIGS. 2–5 illustrate in greater detail the dredging apparatus 20 in accordance with the preferred embodiment of the invention. With reference to FIG. 2, the dredging apparatus comprises a hood 21 having a top wall 22 and a side wall 23 which opens at the back end 24 of the hood. The hood does not include a bottom wall. As illustrated in FIG. 4, the side wall is generally U-shaped. Opposed arcuate surfaces 25, 26 are formed at the front end of the sidewalls so as to prevent the hood from digging into the bottom surface. The hood is preferably composed of fabricated metal such as steel having an outer protective coating to prevent corrosion.

As depicted in FIG. 4, a plurality of substantially parallel skids 27 extend in a downward direction from the top wall 22 of the hood. The skids each have vertical portions 28 which are attached to the interior surface (not shown) of the top wall of the hood and extend toward the bottom of the hood. The vertical portions are preferably attached to the hood by welding. The skids each also include horizontal base portions 29 which extend substantially the length of the hood. The base portions rest on the bottom of the waterway and prevent the hood from digging into solid rock, gravel and other hard bottom surfaces. The portion 30 of each skid intermediate the vertical and base portion is arcuate so as to discourage digging from occurring.

With reference to FIGS. 1 and 2, the hood is connected to the front section 15 of the boom of the excavator by a rectangular bracket 31. A matching bracket (not shown) is disposed on the opposite side of the boom. The bracket is fastened to a bracket mounting base 32 which surrounds the housing 33 of a submersible hydraulic dredge pump 34. The dredge pump draws liquid and solids from the channel and transports the dredged material via outlet line 19 to the spoil collection area 80. The dredge pump is powered by a hydraulic motor 35 having associated hydraulic lines 36. The motor drives an impeller (not shown) contained in the housing when the pump is operated. Outlet line 19 is connected to the housing. The outlet line may optionally extend to a suitable collection vehicle for transporting the dredged material to a disposal site.

The dredging apparatus is particularly suitable for use in removing solids having a low specific gravity relative to water. Such solids are difficult to remove by a conventional dredging apparatus having a scoop because they suspend in the water. When water containing such light solids enters a scoop, the solids suspend above the bottom wall of the scoop and tend to drain out with the water. The dredge pump of the apparatus in accordance with the invention overcomes this problem by drawing the solids into the inlet line and thus preventing the solids from exiting the hood after entering its interior space. The dredging apparatus is accordingly particularly suitable for use in waterways having lightweight sediment such as decayed plants. It will be apparent to those skilled in the art that the dredging apparatus is also suitable for use in environments having relatively heavier sediment as well.

To facilitate dredging over a broad region of the waterway without having to repeatedly move the excavator, the dredging apparatus comprises means for rotating the hood. As illustrated in FIGS. 2–4, the rotating means comprises a sprocket 37 attached to the exterior surface of a cylindrical sleeve 38, a chain 39 having links which engage the sprocket, and a pair of two-way hydraulic powered cylinders 40, 41 having extendible rods 42, 43, respectively, connected to the opposite ends of the chain. The hydraulic cylinders are controlled by hydraulic lines 44, 45 which extend from the hydraulic cylinders to a suitable hydraulic power source such a hydraulic unit 17 (FIG. 1) disposed on the excavator. As illustrated in FIG. 1, the hydraulic unit also provides power to the dredge pump via a hydraulic line 18.

The hood is capable of rotating over an angular range of about 180°. To rotate the hood, the rod of one of the hydraulic cylinders 40, 41 is extended while the rod of the other cylinder is simultaneously retracted. This synchronized movement of the rods causes the chain 39 to be pulled toward the retracting cylinder and away from the extending cylinder. Movement of the chain causes the sprocket 37 to rotate, which in turn causes the sleeve 38 to rotate in the same angular direction as the sprocket.

As illustrated in FIG. 5, a plurality of rotary bearings 46 are disposed on opposite sides of a plate 47 enclosed by a bearing cover 48 to reduce friction during rotation of the hood. The bearing cover receives the sleeve 38 and is fastened to the top wall 22 of the hood by conventional fasteners 49. The bearing cover may optionally be welded to the hood.

With reference to FIGS. 1 and 4, during operation of the dredging apparatus, the hood 20 is placed in the sediment 71 on the bottom of the waterway and manipulated either toward or away from the excavator 10, or from side to side. The rotating hood permits maximum efficiency in the direction of dredging. The skids 27 cause the hood to ride over hard bottom surfaces as it is moved through the sediment. Water and sediment enter the hood through the opening 24 in the sidewall facing the excavator and through the open bottom of the hood (see FIG. 4). The dredged material D is drawn into a cylindrical inlet line 50 by the dredge pump 34 (FIG. 2). The dredged material travels upward through the inlet line, the housing of the dredge pump, and out of the dredge pump apparatus by way of the outlet line 19.

The dredged material is then deposited in the spoil collection area 80.

The sediment concentration and viscosity of the dredged material influences the operation of the dredging apparatus. As the sediment concentration or the viscosity increases, clogging becomes increasingly more likely to occur in the inlet line. As a consequence of clogging, the rate of removal of dredged material from the waterway is reduced and the turbidity of the waterway is increased.

In accordance with the invention, a supply system for supplying replacement water to the interior of the hood adjacent to the inlet opening to prevent clogging of the inlet line is provided. As illustrated in FIG. 5, the supply system comprises a replacement water line 84 which extends from a water source such as the spoil collection area 84 (see FIG. 1). The replacement water line empties into a channel 51 formed between the sleeve 38 and the outer surface of the inlet line. As represented by the arrows, R, the replacement water flows down through the channel and exits the bottom end 52 of the channel. The replacement water enters the waterway and mixes with the sediment and water represented by arrows, D, as it is being drawn into the inlet opening. The replacement water consequently decreases the sediment concentration of the material that enters the inlet line.

In accordance with the invention, the replacement water is introduced into the channel 51 in response to sensed pressure variations in the inlet line 50. As illustrated in FIG. 5, the supply system comprises a sensor 53 for sensing the pressure within the inlet line. The sensor is preferably a pressure transducer positioned on the inner surface of the inlet line. Other suitable waterproof pressure sensors may optionally be used. The sensor preferably continuously monitors the pressure in the inlet line so that variations in pressure caused by clogging are immediately detected.

In accordance with the invention, the supply system further comprises a control device for controlling the supply of replacement water to the inlet opening based on the pressure variations sensed by the pressure transducer during operation of the dredging apparatus. The control preferably comprises a programmable microprocessor 54 which receives signals from the pressure transducer via a line 55. The microprocessor preferably continuously monitors the pressure signals and compares them to programmed pressure data previously determined by calibrating the apparatus. When clogging occurs in the inlet line, the sensed pressure varies from a predetermined value which corresponds to a non-clogged condition. For example, the pressure may decrease as the level of flow of dredged material through the inlet line decreases and the dredge pump continues to operate.

In such instances when a change in the inlet line is sensed by the transducer, the microprocessor sends signals to a metering device for metering the amount of replacement water supplied to the channel. The metering device preferably comprises a metering valve 56 which may be electrically or mechanically controlled. As the level of clogging increases, the metering valve allows a progressively greater amount of replacement water to enter the channel. When clogging is eliminated, the pressure in the inlet line returns to the pressure representing a non-clogged condition. The microprocessor determines when this condition is reached, and then signals the metering valve to close, deactivates the pump and thereby terminates the flow of replacement water into the channel 51.

By providing replacement water to the inlet line during operation of the dredging apparatus, sediment is continuously drawn into the inlet line from the waterway. Accordingly, a larger amount of sediment is removed from the waterway during each passage of the hood through the sediment. This reduces the number of times the hood must be manuevered through the sediment, and so reduces the duration of the dredging operation.

Furthermore, the level of disturbance of the bottom of the waterway which would otherwise occur in the known dredging apparatuses is minimized. Consequently, the turbidity of the waterway is minimally affected by the dredging operation. The dredging system in accordance with the invention thus provides the advantage of minimally disturbing the waterway and the larger ecosystem.

An additional advantage of minimally increasing the turbidity of the waterway is that the operator of the excavator is better able to visually monitor the location of the hood in the water, and thus can more completely and efficiently conduct the dredging operation.

By returning the water from the spoil collection area to the dredging site, the need for an external source of replacement water is eliminated. Accordingly, dredging can be practiced in remote areas where external sources of replacement water are unavailable. Also, the closed circuit reduces the amount of water removed from the waterway. The closed dredging circuit ensures a continuous and convenient source of replacement water, and promotes water conservation.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A dredging apparatus for dredging a waterway containing sediment, comprising:

a submersible hood having an entry passage for water and sediment;

a submersible dredge pump apparatus comprising a housing, an inlet line having an inlet opening in communication with the entry passage of said hood, an outlet line in communication with said inlet line and extending exteriorly from said housing, a dredge pump adapted to draw water and sediment from within the entry passage into said inlet opening and through said inlet line and said outlet line, and supply means for supplying replacement water from a water source into the entry passage adjacent to said inlet opening in response to pressure variations in said inlet line, said supply means being adapted to supply an effective amount of replacement water said entry passage to eliminate clogging of said inlet line by sediment.

2. The dredging apparatus of claim 1, wherein said supply means comprises sensing means for sensing the pressure within said inlet line, and control means for controlling the supply of replacement water into the entry passage of the hood based on the pressure sensed by said sensing means.

3. The dredging apparatus of claim 2, wherein said supply means further comprises a sleeve surrounding said inlet line and defining a channel therebetween, a replacement water line extending to the water source and communicating with said channel, and metering means connected to said replacement water line for metering the amount of replacement water supplied to said channel in response to receiving a signal from said control means.

4. The dredging apparatus of claim 3, wherein said control means comprises a programmable microprocessor.

5. The dredging apparatus of claim 4, wherein said metering means comprises a metering valve.

6. The dredging apparatus of claim 5, wherein said sensing means comprises a pressure transducer.

7. The dredging apparatus of claim 1, wherein the water source is a spoil collection area.

8. The dredging apparatus of claim 1, wherein said hood further includes a plurality of skids forming a base.

9. The dredging apparatus of claim 3, further comprising means for rotating said pump apparatus relative to said hood.

10. The dredging apparatus of claim 9, wherein the rotating means includes a sprocket connected to an outer surface of said sleeve, a pair of hydraulic cylinders each having an extendible and retractable arm, and a chain engaging said sprocket and having opposite ends each connected to an arm.

11. A dredging system for dredging a waterway containing sediment, comprising:

an excavator having a boom; and a dredging apparatus comprising:

a submersible hood connected to said boom, said hood having an entry passage for water and sediment; and a submersible dredge pump apparatus comprising a housing, an inlet line having an inlet opening in communication with said entry passage of said hood, an outlet line in communication with said inlet line and extending exteriorly from said housing to a spoil collection area, a dredge pump adapted to draw water and sediment from within said entry passage into said inlet opening and through said inlet line and said outlet line, and supply means for supplying replacement water from a water source into said entry passage adjacent to said inlet opening from a water source in response to pressure variations in said inlet line, said supply means being adapted to supply an effective amount of replacement water into said entry passage to eliminate clogging of said inlet line by sediment.

12. The dredging system of claim 11, wherein said supply means comprises sensing means for sensing the pressure within said inlet line, and control means for controlling the supply of replacement water into said entry passage based on the pressure measured by said sensing means.

13. The dredging system of claim 12, wherein said supply means further comprises a sleeve surrounding said inlet line and defining a channel therebetween, a replacement water line extending to the water source and communicating with said channel, and metering means connected to said replacement water line for metering the amount of replacement water supplied to said channel in response to receiving a signal from said control means.

14. The dredging system of claim 13, wherein said control means comprises a programmable microprocessor.

15. The dredging system of claim 14, wherein said metering means comprises a metering valve.

16. The dredging system of claim 15, wherein said sensing means comprises a pressure transducer.

17. The dredging system of claim 14, wherein said water source is the spoil collection area.

18. The dredging system of claim 17, wherein said supply means further comprises a replacement water pump for drawing replacement water from the spoil collection area and transporting the replacement water through said replacement water line to said dredge pump apparatus.

19. The dredging system of claim 11, wherein said hood further includes a plurality of skids forming a base.

20. The dredging system of claim 13, further comprising means for rotating said pump apparatus relative to said hood.

21. The dredging system of claim 20, wherein the rotating means includes a sprocket connected to an outer surface of said sleeve, a pair of hydraulic cylinders each having an extendible and retractable arm, and a chain engaging said sprocket and having opposite ends each connected to an arm.

22. A method for dredging a waterway containing sediment, comprising:

providing a submersible hood having an entry passage for water and sediment;

providing a submersible dredge pump apparatus comprising a housing, an inlet line having an inlet opening in communication with said entry passage of said hood, an outlet line in communication with said inlet line and extending exteriorly from said housing, a dredge pump adapted to draw water and sediment from within said entry passage into said inlet opening and through said inlet line and said outlet line, and supply means for supplying replacement water from a water source into said entry passage adjacent to said inlet opening in response to pressure variations in said inlet line, said supply means being adapted to supply an effective amount of replacement water into said entry passage to eliminate clogging of said inlet line by sediment; and removing water and sediment from the waterway using said hood and said submersible pump apparatus.

* * * * *